US006303220B1

(12) United States Patent
Minamoto et al.

(10) Patent No.: US 6,303,220 B1
(45) Date of Patent: Oct. 16, 2001

(54) POLYETHYLENE FIBER AND A NON-WOVEN FABRIC USING THE SAME

(75) Inventors: Koji Minamoto; Masayasu Suzuki, both of Shiga (JP)

(73) Assignee: Chisso Corporation, Osaka (JP)

( * ) Notice: Subject to any disclaimer, the term of this patent is extended or adjusted under 35 U.S.C. 154(b) by 0 days.

(21) Appl. No.: 09/449,568

(22) Filed: Nov. 29, 1999

(30) Foreign Application Priority Data

Nov. 30, 1998 (JP) ..... 10-339916

(51) Int. Cl.[7] ..... D01F 6/00; D01F 6/04; D01F 8/06

(52) U.S. Cl. ..... 428/364; 428/370; 428/373; 428/374; 442/352; 442/353; 442/361; 442/364

(58) Field of Search ..... 428/364, 370, 428/373, 374; 442/352, 353, 361, 332, 364

(56) References Cited

U.S. PATENT DOCUMENTS 4,874,660 * 10/1989 Kubo et al. ..... 428/398
5,487,943 * 1/1996 Kozulla ..... 428/373
5,540,992 * 7/1996 Marcher et al. ..... 428/373

FOREIGN PATENT DOCUMENTS 6-508892 10/1994 (JP) .
WO-93/01334 1/1993 (WO) .

OTHER PUBLICATIONS

"Testing Methods for Man–Made Staple Fibres", Japanese Industrial Standard, JIS L 1015–1981.

* cited by examiner

*Primary Examiner*—N. Edwards
(74) *Attorney, Agent, or Firm*—McDermott, Will & Emery

(57) ABSTRACT

A polyethylene fiber having a high apparent Young's modulus, high breaking tensile strength and low breaking elongation. The fiber also exhibits residual percentage crimp suitable enough for carding, so that the cardability, which has been conventionally difficult to improve, can be remarkably increased. Further, the fiber can be formed into a non-woven fabric having a soft touch feeling such that the fabric is suitable for medical use as well as hygienic use. In addition, the polyethylene fiber of this invention can be mixed with other fibers such as cellulose fiber to obtain a high absorbent fiber network material.

13 Claims, No Drawings

POLYETHYLENE FIBER AND A NON-WOVEN FABRIC USING THE SAME

This invention relates to a polyethylene fiber and a non-woven fabric comprising the polyethylene fiber. More specifically, this invention relates to a polyethylene fiber being soft and having good touch feeling suitable mainly for medical use and to a non-woven fabric using the polyethylene fiber and medical or hygienic materials using the same.

BACKGROUND OF THE INVENTION

Presently, disposable materials made of non-woven fabrics for medical use such as surgical caps, surgical sheets, surgical covering clothes, surgical gowns are spreading rapidly. Problems of hospital infection such as an infection of MRSA (methicillin-resistant Staphylococcus aureus), hepatitis, HIV (human immunodeficiency virus) or O-157 necessitate the use of disposable materials. Further, using disposable non-woven materials requires no necessity for cleaning, so that nursing can be simplified without deteriorating nursing quality. Also it can be one of solutions for a labor shortage that has been becoming serious social problem. The non-woven fabric for medical use is required to have bacteria barrier property, anti-permeability, water repellency, lint free property and so on, but also importantly the fabric is required to have good wear feeling, strong tenacity and cost performance because the fabric is disposable for only one time use.

As raw materials of fibers for a non-woven fabric, polyethylenes, polypropylenes and polyesters are widely used. It is conventional to use these raw materials to make non-woven fabrics for medical use. However, the fabrics made with these raw materials have some disadvantages. For example, non-woven fabrics for medical use are frequently disinfected under radiation. Polypropylene fibers lose their tenacity under radiation because chemical bonds on tertiary carbon atoms are cut, thus making polypropylene not very suitable for as a non-woven fabric material. While radiation does not weaken the tenacity of the polyester fibers, the cost of polyester resins is higher than polyolefin resins. And when polyester non-woven fabric having high basis weight is used to make the fabric tenacious enough to avoid being torn by user's body action, or to make the fabric opaque, the fabric becomes hard and has poor wear feeling, or lacks a light feeling due to the nature of the polyester resin. Because of these disadvantages, polyester non-woven fabrics are not generally used to make fabrics for medical use. Contrary to this, polyethylene resins are useful in making non-woven fabrics for medical because they produce soft non-woven fabrics due to the nature of the resin material. In addition, polyethylene resins do not have tertiary carbon atoms to weaken the tenacity under radiation.

However, conventional polyethylene fibers do not have enough stiffness due to the raw material resin's nature of softness, so it has been a problem that crimps which withstand a tension under carding process cannot be provided. It has been conventionally known that some polyethylene fibers and non-woven fabrics experimentally obtained are very soft, but in view of commercial practice, it has been very difficult to process them into high quality non-woven fabric at low cost, so a polyethylene fiber having good cardability is strongly desired. As a polyethylene fiber for medical use, for example, Japanese Tokkyo Kohyo Koho Hei 6-508892 (corresponds to PCT gazette WO93/01334) discloses a composite fiber composed of a high density polyethylene as a core component and a copolymer of ethylene and other α-olefin (described linear low density polyethylene hereinafter) as a sheath component. However, the above fiber has weak retainability of crimps due to low breaking tensile strength and high breaking elongation, so that when the fiber is wound on a cylinder or doffer during the carding process, it may not be well ejected as a web or sometimes it makes neps. Thus, there some problems associated with conventional polyethylene fibers employed in the prior art.

SUMMERY OF THE INVENTION

This invention aims to present a polyethylene fiber having superior crimp retainability at carding process than conventional polyethylene fibers, and also having excellent radiation resistance, thus making the fibers useful for non-woven fabric for medical uses.

The present inventors have diligently solved the above problems associated with conventional polyethylene fibers by providing a polyethylene fiber having at least 2% of residual percentage crimp and by providing a polyethylene fiber spun and stretched to have at least 60 kg/mm$^2$ of apparent Young's modulus, at least 1.5 g/d of breaking tensile strength, 150% or less of breaking elongation.

The present invention provides for a polyethylene fiber consisting of at least one polyethylene resin, having at least 60 kg/mm$^2$ of apparent Young's modulus, at least 1.5 g/d of breaking tensile strength, 150% or less of breaking elongation, and at least 2% of residual percentage crimp.

The present invention also provides for a polyethylene fiber consisting of at least one polyethylene resin, having at least 80 kg/mm$^2$ of apparent Young's modulus, at least 3.2 g/d of breaking tensile strength, 110% or less of breaking elongation, and at least 2% of residual percentage crimp.

The present invention still further provides for the polyethylene fiber according to the above, wherein the polyethylene resin is a single component of high density polyethylene.

The present invention still further provides for the polyethylene fiber according to the above, wherein the polyethylene resin is a single component of linear low density polyethylene.

The present invention still further provides for the polyethylene fiber according to the above, wherein the fiber has a composite fiber configuration consisting of two different polyethylene resin components having at least 3° C. of melting points difference, wherein the first component is the polyethylene resin having higher melting point and the second component is the polyethylene resin having lower melting point.

The present invention still further provides for the polyethylene fiber according to the above, wherein the fiber has a composite fiber configuration consisting of two different polyethylene resin components having at least 3° C. of melting points difference, and the first component having higher melting point is the high density polyethylene resin and the second component having lower melting point is the linear low density polyethylene resin.

The present invention still further provides for the polyethylene fiber according to the above, wherein the fiber has a composite fiber configuration consisting of two different polyethylene resin components having at least 3° C. of melting points difference, and the first component having higher melting point is the high density polyethylene resin and the second component having lower melting point is the low density polyethylene resin.

The present invention still further provides for the polyethylene fiber according to the above, wherein the fiber has a composite fiber configuration consisting of two different polyethylene resin components having at least 3° C. of melting points difference, and the first component having higher melting point is the linear low density polyethylene resin and the second component having lower melting point is the low density polyethylene resin.

The present invention still further provides for the polyethylene fiber according to the above to be formed into a non-woven fabric.

The present invention still further provides for the non-woven fabric comprising polyethylene fiber according to the above, wherein the polyethylene fiber is mixed with an other fiber which is substantially non-thermo-bondable at a temperature the polyethylene fiber is thermally bonded.

The present invention still further provides for the non-woven fabric comprising the polyethylene fiber according to the above, wherein a web of the polyethylene fiber is point-bonded by point-bonding process.

The invention still further provides for the non-woven fabric comprising the polyethylene fiber according to the above, wherein the web of polyethylene fiber is treated by hydro-entanglement process.

Finally, the invention still further provides for the non-woven fabric comprising the polyethylene fiber according to the above, wherein the web of the polyethylene fiber is treated by hydro-entanglement process, then point-bonded by point-bonding process.

DETAILED DESCRIPTION OF THE INVENTION

The polyethylene resin defined in this invention covers high density polyethylene, linear low density polyethylene and low density polyethylene, each polyethylene resin being classified based on its density and melting point as the following.

High density polyethylene defined in this invention is a homopolymer of ethylene or a copolymer consisting of ethylene and maximum 2 wt % of $C_3$–$C_{12}$ α-olefin, polymerized by a low pressure method using conventional Ziegler-Natta catalyst, and generally having 0.941–0.965 g/cm$^2$ of density.

Linear low density polyethylene defined in this invention is a copolymer consisting of ethylene and generally 15 wt % or less of $C_3$–$C_{12}$ α-olefin, polymerized by using conventional Ziegler-Natta catalyst, substantially having no branched long chain, and generally having 0.925–0.940 g/cm$^2$ of density and less than 127° C. of melting point.

Low density polyethylene defined in this invention is a polyethylene polymerized by high pressure method, generally having 0.910–0.940 g/cm$^2$ of density and 120° C. or less of melting point, having many branched chains, and low crystallinity.

Furthermore, as other kinds of polyethylene are within the scope of the invention. A polyethylene resin polymerized with a metallocene catalyst also can be used as a raw material of this invention. This resin has the advantage of having a lower melting point than the above resins. Thus, during processing, its fibers are bonded thermally each other at low temperature. At the same time, this resin contributes to spinnability because of its narrow molecular weight distribution.

The polyethylene fiber defined in this invention can be a mono-component polyethylene fiber or a composite fiber consisting of two polyethylene components. As a mono-component polyethylene fiber, the fiber consisting of high density polyethylene or linear low density polyethylene can be exemplified. The two component composite fiber can be a combination of two of the following components: high density polyethylene resin, linear low density polyethylene resin and low density polyethylene resin with the condition that the difference in the melting points of the two components is at least 3° C. As such combination of the first and the second components for example, high density polyethylene/linear low density polyethylene, high density polyethylene/low density polyethylene, linear low density polyethylene/low density polyethylene. Furthermore, the composite fiber can be spun into side-by-side configuration, concentric sheath-core configuration, eccentric sheath-core configuration, multi-layer configuration or islands-in-sea configuration.

As a means for producing the fiber of this invention, conventional melt spinning method and its apparatus can be used. Melt flow rates (abbreviated as MFR hereinafter) of high density polyethylene, linear low density polyethylene and low density polyethylene used in the melt spinning method are within the range of 2–50 g/10 min, more preferably within the range of 10–40 g/10 min. Additionally, the melt flow rate defined in this invention is the value measured according to JIS K7210 (190° C., 2160 g).

In the case of producing the composite fiber, the weight ratio of the first component to the second components is preferably within the range of 30:70–70:30, but considering the productivity, it is more preferably within 40:60–60:40. The melting points difference between the two components used as the raw materials of the composite fiber is preferably at least 3° C. The melting points difference defined in this invention is the temperature difference between two peaks of the higher and the lower melting points observed on DSC (differential scanning calorimetry) curve which is given by differential thermal analyzer measurement of the fiber of this invention. If the difference in the melting points is less than 3° C., then the peak of the higher melting point and the peak of the lower melting point are observed to be one, so that the thermo-bondability is not effectively given to the fiber. The raw material resins used for the fiber of this invention may contain a conventionally known additive such as an antioxidant, a light resistant, a flame retardant, or a pigment within the range that the aim of this invention is not hindered.

As the method for stretching the polyethylene fiber of this invention, conventional method of heated rolls stretching or stretching in hot water can be applied, but what is desired is special stretching condition for increasing degree of crystal orientation in the fiber as discussed later. Further, as the method for providing crimps, means for mechanical crimping by a conventional stuffer box can be used. Additionally for the fiber of this invention, a conventional antistatic agent, a finishing agent or the like can be used appropriately when it is necessary in either of the spinning or the stretching process.

According to this invention, non-conventional polyethylene fiber having good cardability can be obtained, but it is necessary that the finally obtained fiber has at least 60 kg/mm$^2$ of apparent Young's modulus, at least 1.5 g/d of breaking tensile strength, 150% or less of breaking elongation, and at least 2% of residual percentage crimp. If the breaking tensile strength of the polyethylene fiber is less than 1.5 g/d or its breaking elongation is more than 150%, the fiber exhibits deteriorating retainability of crimps and poor mechanical properties. If the residual percentage crimp is less than 2%, crimps of the fiber is kept slacked under the carding process when the fiber is wound on cylinder or doffer. As a result, it becomes a problem that the web is not ejected well from the carding machine or neps appear. For making the residual percentage crimp at least 2%, it is necessary to make the fiber having at least 60 kg/mm$^2$ or preferably at least 80 kg/mm$^2$ of the apparent Young's modulus, at least 1.5 g/d or preferably at least 3.2 g/d of the breaking tensile strength, and 150% or less or preferably 110% or less of breaking elongation. To obtain the fiber having such a high stiffness, it is important to increase the degree of the crystal orientation in the fiber in the stretching process.

As the method for increasing degree of the crystal orientation in the fiber and obtaining the fiber having high stiffness, it is effective to increase the spinning speed, or to stretch at high stretching ratio as possible. Namely, comparing with a stretching ratio as a general manner that is 3–5 times, higher stretching ratio (e.g. at least 5–6 times) can increase the stiffness of the fiber more than conventional fibers. For increasing the stiffness of the fiber, it is preferable to increase the stretching ratio still more, that is at least 8 times, and more preferably at least 10 times, so as to provide a polyethylene fiber having the stiffness much more higher than that of conventional polyethylene fibers. The upper limit of the stretching ratio depends on the fineness of the spun fiber (unstretched fiber), but it can be possible to increase the stretching ratio as far as the fiber is not broken. Additionally, the method for the stretching is not only one stage stretching, but also two stage stretching, multistage stretching or stretching in hot water can be used. Among these, for increasing the degree of the crystal orientation of the fiber, especially preferable is the stretching in hot water in which the fiber does not get fuzzy and can be stretched at high stretching ratio. Thus, the fiber obtained by the above manner has appropriate stiffness, so that it can be possible to increase remarkably the cardability of the fiber having a fineness around 2 denier, which has been nearly impossible.

Further, it is also important to take care of the retainability of crimps once provided not to be weakened. For this purpose, it is desirable to make a heat treatment enough for heat setting to the fiber before crimping process, that is just before the fiber is put into the stuffer box (for example, the heat treatment can be done by steam), and to make a temperature of drying process after crimping process as low as possible (the temperature is usually 50–90° C. for drying, but if the drying is completed enough, the temperature can be lower). It is necessary to pay attention to all of these conditions, and if not, the residual percentage crimp would be decreased, and the retainability of crimps of the obtained fiber tends to be poor as a result.

The polyethylene fiber of this invention is cut to give short fibers (staple fibers) by conventional method before carding, and can be used as a raw material of the non-woven fabric. The length of the short fibers as the raw material of non-woven fabric is not limited, but it is generally within the range of 25–125 mm, preferably 38–64 mm.

The non-woven fabric being exemplified is a non-woven fabric known as "Spun Lace" and is obtained by entangling fibers in a web under high pressure water stream (hydro-entanglement process). A method for entangling fibers in a web to form a non-woven fabric known as "Point-bond" in which fibers of the web are bonded to each other by point-bonding process by passing the web between a heated embossing roll and a flat roll to form the non-woven fabric. The non-woven fabric is then processed by the embossing process after the above spun lace process. Any of these non-woven fabrics has soft touch feeling, high draping property, and can be used appropriately. Furthermore, the fiber of this invention can be mixed together with other fiber which is substantially non-thermo-bondable at the temperature that the fiber of this invention is thermally bonded, within the range that the aim of this invention is never hindered. For example of the other fiber, being exemplified is a synthetic fiber such as a polypropylene fiber, a polyester fiber, polyamide fiber or a polyacryl vinylon, a regenerated fiber such as a rayon, a cupra, an acetate, a cotton, a wool, a silk, a hemp or a pulp fiber, or an animal fiber.

The polyethylene fiber of this invention and the non-woven fabric obtained using the same has softness and is not degraded under radiation. Also the fiber itself has an appropriate stiffness, so that it is excellent for being processed into a non-woven fabric. For this reason, it can be preferably used for making medical articles such as surgical gowns, surgical covering clothe sets, pads for childbirth, caps, masks, sheets and antibacterial mats, hygienic materials such as absorbent articles (disposable diapers and napkins), first aid materials (gauze and adhesive plasters) and wiping materials (wet tissues and cosmetic clothes). Furthermore, the fiber obtained by this invention has thermo-bondability, so that it is possible to obtain gathered fiber material mixed with other fiber supporting the other fiber in thermally bonded network, even the other fiber is substantially non-thermo-bondable at the temperature which the fiber of this invention is thermally bonded. For example of the other fiber, a cellulose fiber such as a rayon and a pulp, or a polyester fiber and acryl fiber can be exemplified.

EXAMPLES

This invention is embodied by the following examples, but this invention should not be interpreted as being limited within the examples. Additionally, the examples and the comparative examples are summarized on Table 1 to 6. Each value of physical property data is measured by the following manner.

The breaking tensile strength and the breaking elongation were measured according to JIS L1015 7. 7. 1, the apparent Young's modulus was obtained in accordance with JIS L1015 7. 11, and the residual percentage crimp was obtained according to JIS L 1057. 12. 2.

The breaking tenacity of the non-woven fabric was measured using Shimadzu autograph AG-500D. As for the MD (machine direction) and CD (cross direction) components of the breaking tenacity test, a non-woven fabric sample of MD 15 cm by CD 5 cm for MD breaking tenacity test was prepared and a sample of MD 5 cm by CD 15 cm for the CD breaking tenacity test was prepared. Each sample was fastened between a pair of air chucks set to a distance of 10 cm, and the sample was tensed downward with tensile speed at 200 mm/min to give a tensile stress tenacity at breakage. Each of MD and CD means a direction along the movement of the non-woven production machine and a direction crossing at right angles to the machine movement.

The cardability was evaluated by observing a web obtained when a raw stock was put into a miniature carding machine, and determined according to the following standard;

○ Uniformed web was obtained without generating neps.

Δ Uniformed web was not obtained.

× Web was cut at ejection from carding machine and not collected, or neps were generated.

The touch feeling of the non-woven fabric was evaluated by 10 panelists. The panelists touched the non-woven fabrics and reported the touch feeling according to the following standard divided into four levels. The points of each Example represents the average of the reported level rounded off to decimal.

4 Very soft

3 Soft

2 Little hard

1 Hard

Additionally, each value units of this invention is expressed according to the common custom of this technical field, but the units can be converted into SI unit system by the following conversion formulas:

Fineness: 1 dtex/f=1.11 d/f

Apparent Young's modulus: 1 kg/mm$^2$=9.80665×10$^4$ Pa

Breaking tensile strength: 1 g/d=0.89 cN/dtex

Numbers of crimps: 1 crimp/inch=0.3937 crimps/cm

However, the significant digits of each value are based on the units originally used.

Example 1

A high density polyethylene having 16 g/10 min of MFR was extruded from spinneret having 0.8 mmϕ of diameter at 250° C. of spinning temperature, then wound at 677 m/min of spinning speed to give an spun fiber of 10.1 d/f. The spun fiber was stretched at 5.9 times of stretching ratio using a hot water stretching machine filled with water heated at 90° C., then zigzag crimps were provided with a stuffer box. The crimped tow was dried at 60° C., and cut to give staple fibers of 51 mm length. The fineness of the fiber obtained was 2.5 d/f, the breaking tensile strength was 3.3 g/d, the breaking elongation was 64.3%, the apparent Young's modulus was 133.6 kg/mm$^2$, the residual percentage crimp was 3.5%, and the number of crimps was 13.2 crimps/inch. The cardability of this fiber was evaluated as ○.

Example 2

A fiber was obtained according to the same way as Example 1, except for the following changes:

the spinning speed: 376 m/min, the fineness of the spun fiber: 18.0 d/f, the stretching ratio: 10.6 times.

The fineness of the fiber obtained was 2.5 d/f, the breaking tensile strength was 4.2 g/d, the breaking elongation was 36.1%, the apparent Young's modulus was 218.2 kg/mm$^2$, the residual percentage crimp was 5.7%, and the number of crimps was 13.8 crimps/inch. The cardability of this fiber was evaluated as ○.

Example 3

A fiber was obtained according to the same way as Example 1, except for the following changes:

a high density polyethylene having 26 g/10 min of MFR was used, the spinning speed: 564 m/min, the fineness of the spun fiber: 12.3 d/f, the stretching ratio: 8.5 times.

The fineness of the fiber obtained was 2.0 d/f, the breaking tensile strength was 3.4 g/d, the breaking elongation was 35.9%, the apparent Young's modulus was 130.7 kg/mm$^2$, the residual percentage crimp was 5.7%, and the number of crimps was 14.1 crimps/inch. The cardability of this fiber was evaluated as ○.

Example 4

A fiber was obtained according to the same way as Example 1, except for the following change:

the stretching ratio: 7.8 times.

The fineness of the fiber obtained was 1.8 d/f, the breaking tensile strength was 3.6 g/d, the breaking elongation was 31.7%, the apparent Young's modulus was 199.6 kg/mm$^2$, the residual percentage crimp was 4.5%, and the number of crimps was 11.4 crimps/inch. The cardability of this fiber was evaluated as ○.

Example 5

A fiber was obtained according to the same way as Example 1, except for the following changes:

a linear low density polyethylene having 20g /10 min of MFR was used, the spinning speed: 376 m/min, the fineness of the spun fiber: 18.0 d/f, the stretching ratio: 5.5 times.

The fineness of the fiber obtained was 3.9 d/f, the breaking tensile strength was 2.0 g/d, the breaking elongation was 128.5%, the apparent Young's modulus was 90.8 kg/mm$^2$, the residual percentage crimp was 2.6%, and the number of crimps was 12.5 crimps/inch. The cardability of this fiber was evaluated as ○.

Example 6

A composite fiber consisting of the high density polyethylene having 16 g/10 min. of MFR as a core component and the linear low density polyethylene having 20 g/10 min of MFR as a sheath component was extruded from spinneret having 0.8 mmϕ of diameter at 250° C., then wound at 484 m/min of spinning speed to give an spun fiber of 14.0 d/f. The sheath/core weight ratio was made to be 50:50. The spun fiber was stretched at 5.9 times of stretching ratio using hot water stretching machine filled with water heated at 90° C., then zigzag crimps were provided with stuffer box. The crimped tow was dried at 60° C., and cut to give staple fibers of 51 mm length. The fineness of the fiber obtained was 2.0 d/f, the breaking tensile strength was 3.4 g/d, the breaking elongation was 37.5%, the apparent Young's modulus was 137.2 kg/mm$^2$, the residual percentage crimp was 5.2%, and the number of crimps was 14.0 crimps/inch. The cardability of this fiber was evaluated as ○.

Example 7

A fiber was obtained according to the same way as Example 6, except for the following changes:

the sheath/core weight ratio of high density polyethylene-:linear low density polyethylene was 70:30, and the high density polyethylene having 20g /10 min of MFR was used as the core component, the stretching ratio: 11.0 times, the spinning speed: 376 m/min, the fineness of the spun fiber: 18.6 dlf.

The fineness of the fiber obtained was 1.6 d/f, the breaking tensile strength was 4.1 g/d, the breaking elongation was 29.1%, the apparent Young's modulus was 233.0 kg/mm$^2$, the residual percentage crimp was 5.9%, and the number of crimps was 10.0 crimps/inch. The cardability of this fiber was evaluated as ○.

Example 8

A fiber was obtained according to the same way as Example 6, except for the following changes:

a low density polyethylene having 16 g/10 min of MFR was used as the sheath component, the spinning speed: 376 m/min, the fineness of the spun fiber: 18.0 d/f, the stretching ratio: 5.6 times, the drying temperature: 80° C.

The fineness of the fiber obtained was 3.8 d/f, the breaking tensile strength was 1.8 g/d, the breaking elongation was 40.0%, the apparent Young's modulus was 86.5 kg/mm$^2$, the residual percentage crimp was 3.5%, and the number of crimps was 12.4 crimps/inch. The cardability of this fiber was evaluated as ○.

Example 9

A fiber was obtained according to the same way as Example 6, except for the following changes:

the high density polyethylene having 20 g/10 min of MFR was used as the core component, and the low density polyethylene having 16 g/10 min. of MFR was used as the sheath component, the spinning temperature: 230° C., the spinning speed: 376 m/min, the fineness of the spun fiber: 18.6 d/f.

the stretching ratio: 5.2 times.

The fineness of the fiber obtained was 4.0 d/f, the breaking tensile strength was 1.6 g/d, the breaking elongation was 135.8%, the apparent Young's modulus was 87.7 kg/mm$^2$, the residual percentage crimp was 2.4%, and the number of crimps was 12.9 crimps/inch. The cardability of this fiber was evaluated as ○.

Comparative Example 1

A fiber was obtained according to the same way as Example 1, except for the following change:

the stretching ratio: 4.6 times.

The fineness of the fiber obtained was 3.1 d/f, the breaking tensile strength was 1.8 g/d, the breaking elongation was 143.2%, the apparent Young's modulus was 60.4 kg/mm$^2$, the residual percentage crimp was 1.6%, and the number of crimps was 14.1 crimps/inch. The cardability of this fiber was evaluated as Δ. Practical satisfying non-woven fabric could not be obtained from this fiber.

Comparative Example 2

A fiber was obtained according to the same way as Example 6, except for the following changes:

the spinning speed: 484 m/min, the fineness of the spun fiber: 14.0 d/f, the stretching ratio: 4.0 times, using stretching rolls heated at 90° C., the drying temperature: 80° C.

The fineness of the fiber obtained was 4.0 d/f, the breaking tensile strength was 1.3 g/d, the breaking elongation was 180.5%, the apparent Young's modulus was 45.1 kg/mm$^2$, the residual percentage crimp was 1.6%, and the number of crimps was 13.2 crimps/inch. The cardability of this fiber was evaluated as Δ. Practical satisfying non-woven fabric could not be obtained from this fiber.

Comparative Example 3

A fiber was obtained according to the same way as Example 7, except for the following changes:

the low density polyethylene having 16 g/10 min of MFR was used as the sheath component, the spinning speed: 564 m/min, the fineness of the spun fiber: 12.3 d/f, the stretching ratio: 4.0 times.

The fineness of the fiber obtained was 3.5 d/f, the breaking tensile strength was 1.6 g/d, the breaking elongation was 204.6%, the apparent Young's modulus was 58.3 k/mm$^2$, the residual percentage crimp was 1.8%, and the number of crimps was 12.7 crimps/inch. The cardability of this fiber was evaluated as Δ. Practical satisfying non-woven fabric could not be obtained from this fiber.

Comparative Example 4

A fiber was obtained according to the same way as Example 6, except for the following changes:

the low density polyethylene having 16 g/10 min of MFR was used as the sheath component, the spinning speed: 484 m/min, the fineness of the spun fiber: 13.3 d/f, the stretching ratio: 3.8 times, using stretching rolls heated at 90° C., the drying temperature: 80° C.

The fineness of the fiber obtained was 4.3 d/f, the breaking tensile strength was 1.2 g/d, the breaking elongation was 77.6%, the apparent Young's modulus was 48.6 kg/mm$^2$, the residual percentage crimp was 1.2%, and the number of crimps was 14.3 crimps/inch. The cardability of this fiber was evaluated as Δ. Practical satisfying non-woven fabric could not be obtained from this fiber.

Comparative Example 5

A fiber was obtained according to the same way as Example 6, except for the following changes:

the linear low density polyethylene having 20 g/10 min of MFR was used as the core component, and the low density polyethylene having 16 g/10 min of MFR was used as the sheath component, the spinning temperature: 230° C., the spinning speed: 376 m/min, the fineness of the spun fiber: 18.0 d/f, the stretching ratio: 3.5 times, using stretching rolls heated at 90° C., the drying temperature: 80° C.

The fineness of the fiber obtained was 5.3 d/f, the breaking tensile strength was 1.0 g/d, the breaking elongation was 135.8%, the apparent Young's modulus was 39.6 kg/mm$^2$, the residual percentage crimp was 1.5%, and the number of crimps was 12.6 crimps/inch. The cardability of this fiber was evaluated as X. Practical satisfying non-woven fabric could not be obtained from this fiber.

Example 10

A spun lace non-woven fabric having 30.9 g/m$^2$ of basis weight was produced using the fiber described in Example 1. The breaking tenacity of this non-woven fabric was MD 7.2 kg/5 cm and CD 0.7 kg/5 cm. Its hand touch feeling was evaluated as 4 points.

Example 11

A spun lace non-woven fabric having 31.5 g/m$^2$ of basis weight was produced using the fiber described in Example 1. This non-woven fabric was processed with an embossing roll having 15% of projecting area heated at 131° C., with 20 kg/cm of line pressure and 10.0 m/min of roll speed. Its breaking tenacity was MD 7.0 kg5 cm and CD 0.6 kg5 cm. Its hand touch feeling was evaluated as 3 points.

Example 12

A spun lace non-woven fabric having 31.8 g/m$^2$ of basis weight was produced using the fiber described in Example 2. The breaking tenacity of this non-woven fabric was MD 7.0 kg/5 cm and CD 0.6 kg/5 cm. Its hand touch feeling was evaluated as 4 points.

Example 13

A spun lace non-woven fabric having 29.3 g/m$^2$of basis weight was produced using the fiber described in Example 3. The breaking tenacity of this non-woven fabric was MD 6.1 kg/5 cm and CD 0.5 kg/5 cm. Its hand touch feeling was evaluated as 4 points.

Example 14

A spun lace non-woven fabric having 34.4 g/m$^2$ of basis weight was produced using the fiber described in Example 4. The breaking tenacity of this non-woven fabric was MD 10.2 kg/5 cm and CD 0.6 kg/5 cm. Its hand touch feeling was evaluated as 4 points.

Example 15

A spun lace non-woven fabric having 34.0 g/m$^2$ of basis weight was produced using the fiber described in Example 1. This non-woven fabric was processed with the embossing roll having 15% of projecting area heated at 118° C., with 20 kg/cm of line pressure and 10.0 m/min of roll speed. Its breaking tenacity was MD 4.3 kg/5 cm and CD 0.5 kg/5 cm. Its hand touch feeling was evaluated as 3 points.

Example 16

A spun lace non-woven fabric having 36.9 g/m$^2$ of basis weight was produced using the fiber described in Example 6. The breaking tenacity of this non-woven fabric was MD 7.0 kg/5 cm and CD 0.4 kg/5 cm. Its hand touch feeling was evaluated as 4 points.

Example 17

A spun lace non-woven fabric having 33.3 g/m$^2$ of basis weight was produced using the fiber described in Example 6. This non-woven fabric was processed with the embossing roll having 15% of projecting area heated at 119° C., with 20 kg/cm of line pressure and 10.0 m/min. of roll speed. Its breaking tenacity was MD 8.3 kg/5 cm and CD 0.7 kg/5 cm. Its hand touch feeling was evaluated as 3 points.

Example 18

A spun lace non-woven fabric having 27.6 g/m$^2$ of basis weight was produced using the fiber described in Example 7. The breaking tenacity of this non-woven fabric was MD 6.9 kg/5 cm and CD 0.3 kg/5 cm. Its hand touch feeling was evaluated as 4 points.

Example 19

A web consisting of the fiber described in Example 8 was processed with an embossing roll having 25% of projecting area heated at 112° C., with 20 kg/cm of line pressure and 6.0 m/min. of roll speed. The basis weight of the obtained non-woven fabric was 32.4 g/m$^2$, and its breaking tenacity was MD 4.5 kg/5 cm and CD 0.6 kg/5 cm. Its hand touch feeling was evaluated as 3 points.

Example 20

A web consisting of the fiber described in Example 9 was processed with the embossing roll having 25% of projecting area heated at 108° C., with 20 kg/cm of line pressure and 6.0 m/min of roll speed. The basis weight of the obtained non-woven fabric was 37.7 g/m$^2$, and its breaking tenacity was MD 3.0 kg/5 cm and CD 0.4 kg/5 cm. Its hand touch feeling was evaluated as 3 points.

Example 21

The staples of the fiber described in Example 7 and a rayon cut into 44 mm length of staples having 2 d/f of fineness were mixed together to have 50:50 of mixing weight ratio, and carded to form a web, then the web was processed with spun lace method to give a non-woven fabric having 35.9 g/m$^2$ of basis weight. This non-woven fabric was processed with the embossing roll having 25% of projecting area heated at 131°C., with 20 kg/cm of line pressure and 6.0 m/min of roll speed. Its breaking tenacity was MD 5.4 kg/5 cm and CD 0.5 kg/5 cm. Its hand touch feeling was evaluated as 3 points.

Example 22

The staples of the fiber described in Example 7 and the rayon cut into 44 mm length of staples having 2 d/f of fineness were mixed together to have 50:50 of mixing weight ratio, and carded to form a web, then the web was processed with spun lace method to give a non-woven fabric having 34.0 g/m$^2$ of basis weight. This non-woven fabric was processed with the embossing roll having 25% of projecting area heated at 122° C., with 20 kg/cm of line pressure and 6.0 m/min of roll speed. Its breaking tenacity was MD 5.1 kg/5 cm and CD 0.7 kg/5 cm. Its hand touch feeling was evaluated as 3 points.

Example 23

The non-woven fabric described in Example 18 was produced using the fiber described in Example 7. This non-woven fabric was processed with the embossing roll having 15% of projecting area heated at 119° C., with 20 kg/cm of line pressure and 10.0 m/min of roll speed. This non-woven fabric was cut into rectangles of MD 14 cm by CD 9 cm, then four of the rectangles were laid one on top of another and were heat-sealed at the four corners. This four layer non-woven fabric was made into a mask attaching elastic strings of 16 cm length at its shorter sides. This mask could be suitably used.

Example 24

A back side material of a commercially available disposable diaper having a shape of a train rail outlined as "I" was peeled off using acetone from a polyethylene film adhered with hot-melt adhesive to said back side material. The non-woven fabric of Example 17 using the fiber described in Example 6 was adhered to the surface of this polyethylene film instead of the peeled back side material. Said disposable diaper originally consisted of a front side material of a non woven fabric in which staples of a polyethylene/polypropylene thermo-bondable composite fiber are bonded each other, and an absorbent material comprising a high water absorbent polymer as main component, and an non-permeable material of the polyethylene film. The back sheet was substituted with the non-woven fabric being adhered to the polyethylene film with hotmelt adhesive. The hand touch feeling of the back side material of this disposable diaper was more improved by the substituted back sheet of the non-woven fabric, and the diaper was more suitably used.

TABLE 1

| | Ex. 1 | Ex. 2 | Ex. 3 | Ex. 4 | Ex. 5 |
|---|---|---|---|---|---|
| Condition of fiber production | | | | | |
| Raw material resin[1] (MFR (g/10 min)) | HDPE (16) | HDPE (16) | HDPE (26) | HDPE (16) | L-LDPE (20) |
| Spinning temp. (° C.) | 250 | 250 | 250 | 250 | 250 |
| Spinning speed (m/min) | 677 | 376 | 564 | 677 | 376 |
| Fineness of spun fiber (d/f) | 10.1 | 18.0 | 12.3 | 10.1 | 18.0 |
| Stretching ratio (times) | 5.9 | 10.6 | 8.5 | 7.8 | 5.5 |
| Temp. of water bath (° C.)[2] | 90 | 90 | 90 | 90 | 90 |
| Drying temp. (° C.) | 60 | 60 | 60 | 60 | 60 |
| Cutting Length (mm) | 51 | 51 | 51 | 51 | 51 |
| Property of fiber | | | | | |
| Fineness of stretched fiber (d/f) | 2.5 | 2.5 | 2.0 | 1.8 | 3.9 |
| Melting point of fiber measured by DSC (° C.) | 132.8 | 133.2 | 133.1 | 133.3 | 122.1 |
| Apparent Young's modulus (kg/mm$^2$) | 133.6 | 218.2 | 130.7 | 199.6 | 90.8 |
| Breaking tensile strength (g/d) | 3.3 | 4.2 | 3.4 | 3.6 | 2.0 |
| Breaking elongation (%) | 64.3 | 36.1 | 35.9 | 31.7 | 128.5 |
| Residual percentage crimp (%) | 3.5 | 5.7 | 5.7 | 4.5 | 2.6 |
| Number of crimps (per inch) | 13.2 | 13.8 | 14.1 | 11.4 | 12.5 |
| Cardability | ○ | ○ | ○ | ○ | ○ |

[1]HDPE: High Density Polyethylene, LDPE: Low Density Polyethylene, L-LDPE: Linear Low Density Polyethylene
[2]Temperature of hot water stretching machine

TABLE 2

| | Ex. 6 | Ex. 7 | Ex. 8 | Ex. 9 |
|---|---|---|---|---|
| Condition of fiber production | | | | |
| Raw material resin of core component (MFR)[1] | HDPE (16) | HDPE (26) | HDPE (16) | L-LDPE (20) |
| Raw material resin of sheath component (MFR)[1] | L-LDPE (20) | L-LDPE (20) | LDPE (16) | LDPE (16) |
| Weigh ratio of core:sheath | 50:50 | 70:30 | 50:50 | 50:50 |
| Spinning temp. (° C.) | 250 | 250 | 250 | 230 |
| Spinning speed (m/min) | 484 | 376 | 376 | 376 |
| Property of fiber | | | | |
| Fineness of spun fiber (d/f) | 14.0 | 18.6 | 18.0 | 18.6 |
| Stretching ratio (times) | 8.2 | 11.0 | 5.6 | 5.2 |
| Temp. of water bath (° C.)[2] | 90 | 90 | 90 | 90 |
| Drying temp. (° C.) | 60 | 60 | 80 | 60 |
| Cutting length (mm) | 51 | 51 | 51 | 51 |
| Fineness of stretched fiber (d/f) | 2.0 | 1.6 | 3.8 | 4.0 |
| Melting point of core component Measured by DSC (° C.) | 128.4 | 129.0 | 128.5 | 123.5 |
| Melting point of sheath component Measured by DSC (° C.) | 122.5 | 122.6 | 108.4 | 107.6 |
| Apparent Young's modulus (kg/mm$^2$) | 137.2 | 233.0 | 86.5 | 87.7 |
| Breaking tensile strength (g/d) | 3.4 | 4.1 | 1.8 | 1.6 |
| Breaking elongation (%) | 37.5 | 29.1 | 40.0 | 135.8 |
| Residual percentage crimp (%) | 5.2 | 5.9 | 3.5 | 2.4 |
| Number of crimps (per inch) | 14.0 | 10.0 | 12.4 | 12.9 |
| Cardability | ○ | ○ | ○ | ○ |

[1]HDPE: High Density Polyethylene, LDPE: Low Density Polyethylene, L-LDPE: Linear Low Density Polyethylene
[2]Temperature of hot water stretching machine

TABLE 3

| | Comp. Ex. 1 | Comp. Ex. 2 | Comp. Ex. 3 | Comp. Ex. 4 | Comp. Ex. 5 |
|---|---|---|---|---|---|
| Condition of fiber production | | | | | |
| Raw material resin of core component (MFR)[1] | HDPE (16) | HDPE (16) | HDPE (26) | HDPE (16) | L-LDPE (20) |
| Raw material resin of sheath component (MFR)[1] | — | L-LDPE (20) | L-LDPE (20) | LDPE (16) | LDPE (16) |
| Weigh ratio of core:sheath | | 50:50 | 70:30 | 50:50 | 50:50 |
| Spinning temp. (° C.) | 250 | 250 | 250 | 250 | 230 |
| Spinning speed (m/min) | 677 | 484 | 564 | 484 | 376 |
| Fineness of spun fiber (d/f) | 10.1 | 14.0 | 12.3 | 13.3 | 18.0 |
| Stretching ratio (times) | 4.6 | 4.0 | 4.0 | 3.8 | 3.5 |
| Temp. of heated roll (° C.) | — | 90 | — | 90 | 90 |
| Temp. of water bath (° C.)[2] | 90 | — | 90 | — | — |
| Drying temp. (° C.) | 60 | 80 | 60 | 80 | 60 |
| Cutting length (mm) | 5.1 | 5.1 | 5.1 | 5.1 | 5.1 |

TABLE 3-continued

| | Comp. Ex. 1 | Comp. Ex. 2 | Comp. Ex. 3 | Comp. Ex. 4 | Comp. Ex. 5 |
|---|---|---|---|---|---|
| Property of fiber | | | | | |
| Fineness of stretched fiber (d/f) | 3.1 | 4.0 | 3.5 | 4.3 | 5.3 |
| Melting point of core component Measured by DSC (° C.) | 130.3 | 129.0 | 127.6 | 128.0 | 123.3 |
| Melting point of sheath component Measured by DSC (° C.) | — | 122.3 | 122.5 | 106.4 | 107.0 |
| Apparent Young's modulus ($kg/mm^2$) | 60.4 | 45.1 | 58.3 | 48.6 | 39.6 |
| Breaking tensile strength (g/d) | 1.8 | 1.3 | 1.6 | 1.2 | 1.0 |
| Breaking elongation (%) | 143.2 | 180.5 | 204.6 | 77.6 | 135.8 |
| Residual percentage crimp (%) | 1.6 | 1.6 | 1.8 | 1.2 | 1.5 |
| Number of crimps (per inch) | 14.1 | 13.2 | 12.7 | 14.3 | 12.6 |
| Cardability | Δ | Δ | x | Δ | x |

[1)]HDPE: High Density Polyethylene, LDPE: Low Density Polyethylene, L-LDPE: Linear Low Density Polyethylene
[2)]Temperature of hot water stretching machine

TABLE 4

| | Ex.10 | Ex.11 | Ex.12 | Ex.13 |
|---|---|---|---|---|
| Used fiber | Fiber of Ex.1 | Fiber of Ex.1 | Fiber of Ex.2 | Fiber of Ex.3 |
| Basis weight ($g/m^2$) | 30.9 | 31.5 | 31.8 | 29.3 |
| Spun lace processing | done | done | done | done |
| Temp. of point-bonding roll (C.) | — | 131 | — | — |
| Projecting area ratio of point-bonding roll (%) | — | 15 | — | — |
| Line pressure of point-bonding roll (kg/cm) | — | 20 | — | — |
| Speed of point-bonding roll (m/min) | — | 10.0 | — | — |
| MD breaking strength (kg/5 cm) | 7.2 | 8.5 | 7.0 | 6.1 |
| CD breaking strength (kg/5 cm) | 0.7 | 1.1 | 0.6 | 0.5 |
| Touch feeling | 4 | 3 | 4 | 4 |

TABLE 5

| | Ex.14 | Ex.15 | Ex.16 | Ex.17 |
|---|---|---|---|---|
| Used fiber | Fiber of Ex.4 | Fiber of Ex.5 | Fiber of Ex.6 | Fiber of Ex.6 |
| Basis weight ($g/m^2$) | 34.4 | 34.0 | 36.9 | 33.3 |
| Spun lace processing | done | done | done | done |
| Temp. of point-bonding roll (C.) | — | 118 | — | 119 |
| Projecting area ratio of point-bonding roll (%) | — | 15 | — | 15 |
| Line pressure of point-bonding roll (kg/cm) | — | 20 | — | 20 |
| Speed of point-bonding roll (m/min) | — | 10.0 | — | 10.0 |
| MD breaking strength (kg/5 cm) | 10.2 | 4.3 | 7.0 | 8.3 |
| CD breaking strength (kg/5 cm) | 0.6 | 0.5 | 0.4 | 0.7 |
| Touch feeling | 4 | 3 | 4 | 3 |

TABLE 6

| | Ex.18 | Ex.19 | Ex.20 | Ex.21 | Ex.21 |
|---|---|---|---|---|---|
| Used fiber | Fiber of Ex.7 | Fiber of Ex.8 | Fiber of Ex.9 | Fiber of Ex.1 | Fiber of Ex.7 |
| Basis weight ($g/m^{2)}$ | 27.6 | 32.4 | 37.7 | 35.9 | 34.0 |
| Spun lace processing | done | not done | done | done | done |
| Temp. of point-bonding roll (C.) | — | 112 | 108 | 131 | 122 |
| Projecting area ratio of point-bonding roll (%) | — | 25 | 25 | 25 | 25 |
| Line pressure of point-bonding roll (kg/cm) | — | 20 | 20 | 20 | 20 |
| Speed of point-bonding roll (m/min) | — | 6.0 | 6.0 | 6.0 | 6.0 |
| MD breaking strength (kg/5 cm) | 6.9 | 4.5 | 3.0 | 5.4 | 5.1 |
| CD breaking strength (kg/5 cm) | 0.3 | 0.6 | 0.4 | 0.5 | 0.7 |
| Mixing ratio of Rayon (%) | | | | 50 | 50 |
| Touch feeling | 4 | 3 | 3 | 3 | 3 |

What is claimed is:

1. A polyethylene fiber consisting of at least one polyethylene resin, having at least 60 $kg/mm^2$ of apparent Young's modulus, at least 1.5 g/d of breaking tensile strength, 150% or less of breaking elongation, and at least 2% of residual percentage crimp.

2. A polyethylene fiber consisting of at least one polyethylene resin, having at least 80 $kg/mm^2$ of apparent Young's modulus, at least 3.2 g/d of breaking tensile strength, 110% or less of breaking elongation, and at least 2% of residual percentage crimp.

3. The polyethylene fiber according to claim 1, wherein the polyethylene resin is a single component of high density polyethylene.

4. The polyethylene fiber according to claim 1, wherein the polyethylene resin is a single component of linear low density polyethylene.

5. The polyethylene fiber according to claim 1, wherein the fiber has a composite fiber configuration consisting of two different polyethylene resin components having at least 3° C. of melting points difference, wherein the first component is the polyethylene resin having higher melting point and the second component is the polyethylene resin having lower melting point.

6. The polyethylene fiber according to claim 1, wherein the fiber has a composite fiber configuration consisting of two different polyethylene resin components having at least 3° C. of melting points difference, and the first component having higher melting point is the high density polyethylene resin and the second component having lower melting point is the linear low density polyethylene resin.

7. The polyethylene fiber according to claim 1, wherein the fiber has a composite fiber configuration consisting of two different polyethylene resin components having at least 3° C. of melting points difference, and the first component having higher melting point is the high density polyethylene resin and the second component having lower melting point is the low density polyethylene resin.

8. The polyethylene fiber according to claim 1, wherein the fiber has a composite fiber configuration consisting of two different polyethylene resin components having at least 3° C. of melting points difference, and the first component having higher melting point is the linear low density polyethylene resin and the second component having lower melting point is the low density polyethylene resin.

9. A non-woven fabric comprising the polyethylene fiber according to claim 1.

10. The non-woven fabric comprising the polyethylene fiber according to claim 1, wherein the polyethylene fiber is mixed with an other fiber which is substantially non-thermo-bondable at a temperature the polyethylene fiber is thermally bonded.

11. The non-woven fabric comprising the polyethylene fiber according to claim 1, wherein a web of the polyethylene fiber is point-bonded by point-bonding process.

12. The non-woven fabric comprising the polyethylene fiber according to claim 1, wherein the web of the polyethylene fiber is treated by hydro-entanglement process.

13. The non-woven fabric comprising the polyethylene fiber according to claim 1, wherein the web of the polyethylene fiber is treated by hydro-entanglement process, then point-bonded by point-bonding process.

* * * * *